United States Patent [19]

Schuetz

[11] Patent Number: 4,762,749

[45] Date of Patent: Aug. 9, 1988

[54] FIBROUS POLYMER INSULATION

[75] Inventor: Mark A. Schuetz, Granville, Ohio

[73] Assignee: Owens-Corning Fiberglas Corporation, Toledo, Ohio

[21] Appl. No.: 761,727

[22] Filed: Aug. 2, 1985

[51] Int. Cl.[4] ..... D02G 3/00

[52] U.S. Cl. ..... 428/372; 428/364; 428/368; 428/394; 428/396; 428/913; 524/495; 524/496; 524/584

[58] Field of Search ..... 428/372, 364, 368, 394, 428/396, 913; 524/495, 496, 584

[56] References Cited

U.S. PATENT DOCUMENTS

| | | | |
|---|---|---|---|
| 2,965,139 | 12/1960 | De Thier | 139/426 |
| 3,016,599 | 1/1962 | Perry, Jr. | 28/78 |
| 3,775,365 | 11/1973 | Mathis et al. | 260/41 |
| 3,793,204 | 2/1974 | Ardary et al. | 252/62 |
| 3,841,953 | 10/1974 | Lohkamp et al. | 161/150 |
| 3,933,557 | 1/1976 | Pall | 156/167 |
| 3,963,647 | 6/1976 | Straub | 252/511 |
| 3,971,373 | 7/1976 | Braun | 128/146.2 |
| 4,002,595 | 1/1977 | Adelman | 260/42.47 |
| 4,061,827 | 12/1977 | Gould | 428/367 |
| 4,118,531 | 10/1978 | Hauser | 428/224 |
| 4,167,604 | 9/1979 | Aldrich | 428/359 |
| 4,216,137 | 8/1980 | Wang et al. | 260/42.46 |
| 4,270,888 | 6/1981 | Kane et al. | 425/66 |
| 4,360,626 | 11/1982 | Manwiller | 524/495 |
| 4,391,941 | 7/1983 | Cotten et al. | 524/495 |
| 4,395,458 | 7/1983 | Huang | 428/372 |
| 4,476,272 | 10/1984 | Pengilly | 524/398 |

FOREIGN PATENT DOCUMENTS

| | | | |
|---|---|---|---|
| 1229456 | 4/1971 | United Kingdom | 524/495 |
| 1417394 | 12/1975 | United Kingdom | 524/495 |

*Primary Examiner*—Sharon A. Gibson

*Attorney, Agent, or Firm*—Robert F. Rywalski; Ted C. Gillespie

[57] ABSTRACT

An improved insulating material comprising a fibrous web of bulking fibers intimately mixed with infrared opacified fibers. The web has a density of between about 0.2 to about 2.00 pounds per cubic foot and a thermal conductivity of less than 0.55 (BTU - in/hr - ft sq - deg F).

4 Claims, 2 Drawing Sheets

FIG. 1: Comparison of Measured Thermal Conductivity of a Web with Graphite versus without Graphite
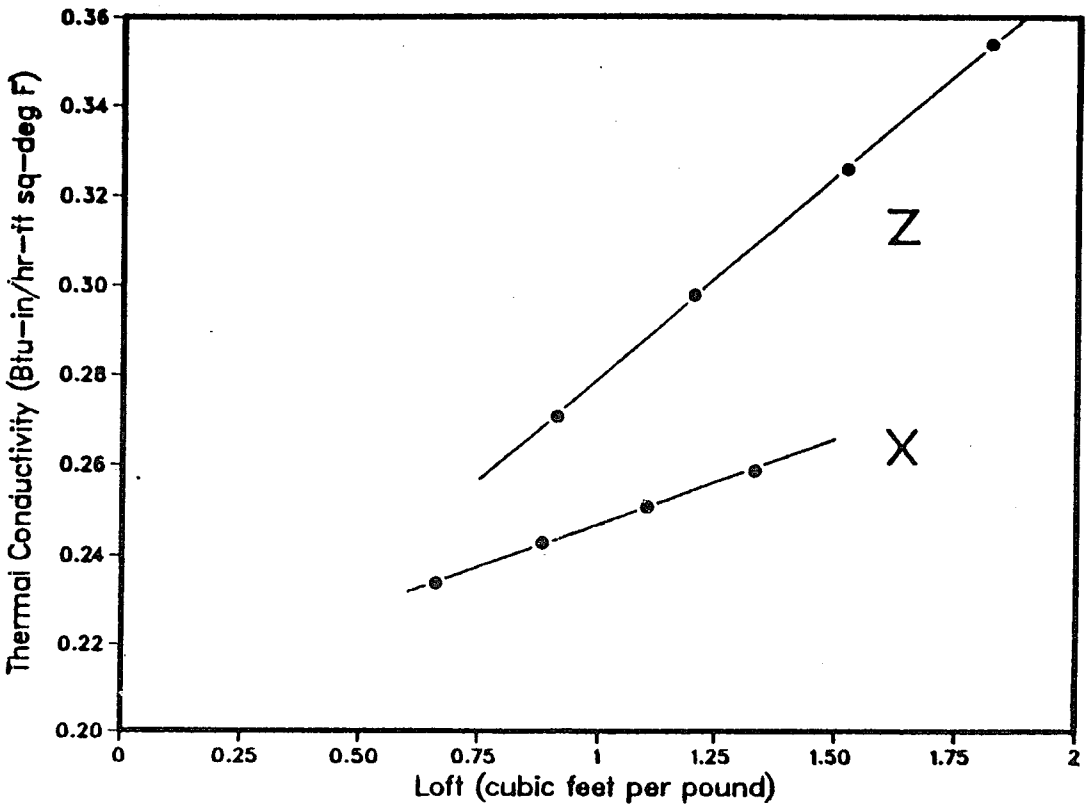

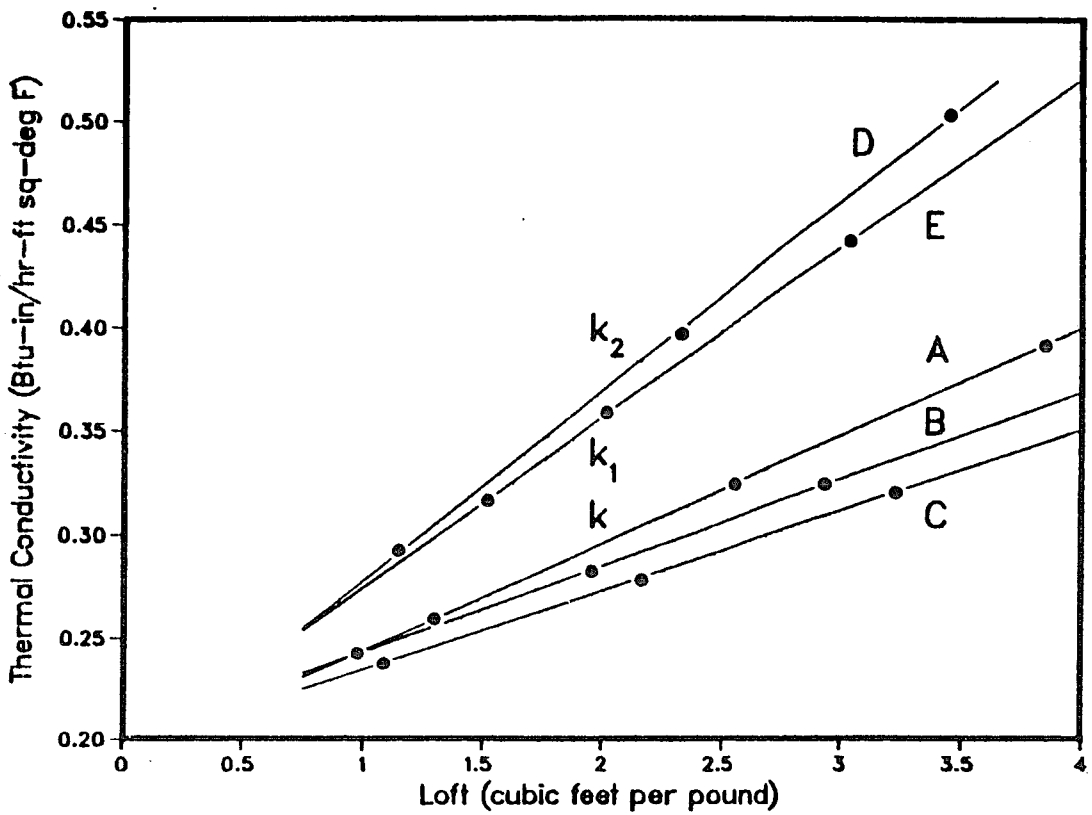
FIG. 2: Comparison of Measured Thermal Performance of Webs Containing Graphite Opacified Fibers versus Webs Not Containing Opacified Fibers

FIBROUS POLYMER INSULATION

TECHNICAL FIELD

The present invention generally relates to thermal insulation material. In one aspect, the invention specifically relates to a thermoplastic polymeric fiber containing graphite. In another aspect, the invention relates to a process for making the thermoplastic fiber. In still another aspect, the invention is related to a fibrous insulating web containing an intimate mixture of two different fibers, one fiber containing an opacifiying material to effectively block infrared transmission through the web.

BACKGROUND AND SUMMARY OF THE INVENTION

Fibrous organic insulating webs are known in the art. The synthetic polymeric materials typically comprising the fibers of such webs are generally relatively weak absorbers of infrared radiation. Consequently, webs in the past have primarily relied upon immobilized air to reduce heat transmission and thereby increase their insulating qualities. However, the insulating value of still air trapped between the fibers of such a web is limited due to the transmission of heat via radiation. Providing an air space within the individual fibers so as to make them hollow only modestly increases the effectiveness of blocking the infrared radiation heat transfer.

It has now been discovered that the insulating effectiveness of a web is significantly increased when polymeric fibers are incorporated into the web which contain an effective infrared absorbing amount of an infrared absorbing additive such as graphite. Such fibers are believed to be rendered substantially opaque to the infrared heat radiation such that they effectively block the radiation heat transfer through the web thereby decreasing the thermal conductivity and increasing the insulating value of such webs.

It has been found that webs containing the opacified fibers of the instant invention demonstrate significantly lower thermal conductivity values than webs at the same loft made of the same intimately blended fibers, but without an infrared opacifying additive. This translates into higher insulating values which means that the webs of the instant invention are substantially warmer than webs of conventional technology. Consequently, it is expected that these webs will find particular utility as fiberfill insulation especially in wearing apparel, sleeping bags and the like.

BRIEF DESCRIPTION OF DRAWINGS

FIG. 1 is a graph comparing the thermal conductivity values for a web of fibers without graphite (Z) versus a similar web of fibers containing graphite (X).

FIG. 2 is a graph comparing the thermal conductivity values for webs of the invention (A,B and C) versus conventional technology (D and E).

DETAILED DESCRIPTION OF THE INVENTION

In one aspect of the present invention, there is provided a thermally insulating fiber comprising a blend of a thermoplastic polymeric material and from about 4% to about 8.5% graphite, said fiber being capable of absorbing infrared radiation. In another aspect, there is provided a process for making a thermoplastic polymeric fiber having enhanced infrared absorbing characteristics. In still another aspect, the invention provides an improved fibrous insulating web comprising an intimate mixture of bulking fibers and infrared opacified fibers, said web having a density of between about 0.2 to about 2.00 pounds per cubic foot (0.003 to about 0.032 grams per cc) and a thermal conductivity of less than 0.55 (BTU - in/hr - ft sq - deg F.) or 0.08 W/m-K.

The thermally insulating fibers opacified to infrared radiation of the present invention can be made from any fiberizable thermoplastic polymer which can be blended and fiberized with an infrared absorber, particularly graphite. Suitable polymers include polyesters, poly (vinylaromatics), such as polystyrene, and polyolefins, including polypropylene and polyethylene. The polyolefins are preferred with polypropylene being most preferred. These polymers are generally referred to as the second polymer when comprising fibers employed in a web of the invention. Suitable polypropylene resins commercially available include Escorene® Polypropylene PD-3125 from Exxon Chemical Americas, Tex., U.S.A.; and DX-5089 and DX-5078 from Shell Oil Company, Tex., U.S.A.

The opacified fibers will desirably have a diameter of less than 20 microns, preferably less than 15 microns, and their fiber length will vary depending upon their use. Excellent results have been obtained where the infrared opacified fibers are smaller than the bulking fibers. When employed in a web of the invention, opacified fibers will have a length convenient for conventional web forming textile processes, such as carding and garnetting, and typically range from about 2 to about 5 cm.

Generally, the opacified fibers are not crimped, however crimping has been found to improve the processability of webs possessing larger concentrations, usually 50% or more, of opacified fibers.

These fibers are rendered substantially opaque to infrared radiation by adding a material capable of absorbing infrared radiation, generally over the entire range of about 5 to about 40 microns of the electromagnetic spectrum and especially from about 7 to about 24 microns, to the polymer comprising such fibers. It should be understood that this infrared absorbing material is an additive used in addition to any conventional, optional processing aids or adjuvants. Although any infrared absorbing material may be used, graphite is preferred because it effectively absorbs infrared radiation over the entire wavelength range noted above, and quite surprisingly permits the fiberization of relatively fine fibers even when incorporated in relatively high concentrations into a polymer, especially polypropylene.

The amount of infrared absorbing material added to the opacified fibers should be an amount which is sufficient to significantly decrease the thermal conductivity of a web of fibers containing the infrared absorber as compared to a web made of fibers of the same substance absent the infrared absorber. A sufficient amount of an infrared absorber, as used above, is an amount wherein the thermal conductivity differential factor is at least 1.0 percent. Thermal conductivity differential factors of 15% or greater have been demonstrated with the instant invention.

The thermal conductivity differential factor as used herein is defined as:

$$\frac{(X_1 - X_2)}{(X_1)} \times 100$$

where:

$X_1$ is the thermal conductivity of an unopacified web made of fibers of a single involved polymer;

$X_2$ is the thermal conductivity of an opacified web made of fibers of the same involved polymer, but containing an infrared absorbing additive; and $X_1$ and $X_2$ are at substantially the same loft and all fibers employed are substantially the same length and diameter.

Typically, the fibers will contain from about 0.5 to about 12% infrared opacifier or infrared absorbing material, based on the total weight of the fiber, although greater quantities may be employed which do not impair the fiber forming process. Good results have been obtained when the fibers contain from about 4% to about 8.5% infrared absorbing additive, about 8.0% to about 8.5% being most preferred.

Any infrared absorber particle size may be used, however, it is preferred that the particle size selected is one which maximizes the material's absorptive effectiveness without interfering with the fiberization process. Small particle sizes which have large surface area per unit weight values usually give the best results. Thus, while graphite particles generally range in size, the smaller particles are preferred due to their superior infrared absorbing qualities and the relative ease that is possible when forming fibers from a polymer compounded with such graphite particles.

Suitably sized graphite particles are those having a diameter of less than 10 microns, and typically they have a mean diameter of from about 2.5 to about 10 microns, based upon optic inspection.

Commercially available graphite suitable in the present invention includes Dixon 200-10 and Dixon 200-8 from Dixon Ticonderoga Company, N.J., U.S.A.; and Micro 850 and Micro 870 from The Asbury Graphite Mills, Inc., N.J., U.S.A. Other graphites ground to similar particle sizes as the Dixon 200-10 should provide similar results.

The infrared absorbing additive is incorporated into the polymer by conventional processing techniques prior to the fiber forming process. Good results have been obtained by dry blending the infrared additive with the polymer and feeding the mixture into a twin screw extruder which melts the polymer, mixes in the infrared absorber at high shear and extrudes the mixture.

When the opacified fibers are utilized in an insulating blanket or web, the fibers may comprise from about 10 to about 90 percent by weight of the insulating web. A web of from about 60% to about 90% opacified fibers is desirable for certain applications, especially for products designed to maximize thermal resistance per inch of web thickness. A web of from about 10% to about 30% opacified fibers is desired for products designed to maximize thermal resistance per pound of insulation.

In the insulating webs of the invention, the opacified fibers are intimately mixed with the bulking fibers to provide loft. The bulking fibers therefore are preferably crimped such that they have a continuous wavy, curly or jagged character along their length. Any crimp frequency, amplitude, form or percent crimp is suitable which gives the web loft. Substantially hollow bulking fibers are also suitable. Coating their surface with a slickening or lubricating agent also gives the bulking fibers better hand.

Any size bulking fibers can be employed so long as they are capable of forming an insulating web especially by conventional techniques, including e.g., carding. Bulking fibers will desirably have a diameter less than 40 microns, preferably less than 20 microns and typically between about 10 and 25 microns. Good results have been obtained with bulking fibers having a length between about 2 and about 5 cm.

The bulking fibers may be comprised of any polymeric material, including synthetic and naturally occurring materials. Suitable natural fibers include wool, cotton and silk. Any synthetic polymer capable of forming fibers can be employed and such polymers include acrylics, acetates, polyamides, rayons, and polyesters, such as polyethylene terephthalate. Bulking fibers made of polyethylene terephthalate are preferred and are commercially available from many sources, including E.I. DuPont de Nemours & Company, Inc., Del., U.S.A. who produce Dacron ® Hollofil ® II and Quallofil fibers; and Eastman Kodak, N.Y., U.S.A. who produce Kodaire ® fibers. Unless otherwise indicated, "polymer" indicates natural or synthetic materials as used for bulking fibers.

Webs of the invention can be of any desired thickness, however this will usually be dictated by the use of the web such as for use in wearing apparel or sleeping bags. Loft, as used herein is defined as the inverse of pack density, and may also vary, but, generally, webs of the present invention will typically have a loft of at least 0.5 cubic foot/pound (31.2 cubic centimeters/gram), and less than about 5 cubic foot/pound (311.8 cubic centimeters/gram) preferably at least 1 cubic foot/pound (62.4 cubic centimeters/gram). The bulk density of the webs generally ranges between about 0.2 and about 2.0 pounds per cubic foot (0.003 and 0.032 grams per cubic centimeter), although higher densities are acceptable.

Webs of the present invention are found to effectively obstruct the transmission of radiant energy such that their thermal conductivity is generally from about 0.22 to about 0.55 (BTU - in/hour - ft sq. - °F.) or 0.032 to 0.08 W/m-K.

Fibers of the web can be made by any method known in the art. The commercially available bulking fibers are generally made by a conventional melt spun process. A melt blown process, exemplified in U.S. Pat. No. 4,270,888, has been found to be suitable for forming the opacified fibers, however, conventional melt spinning processes are preferred. Good results have been obtained by extruding a polymer, such as polypropylene, which has already been compounded with the infrared absorbing additive, through a horizontal spineret. Once extruded, the filaments dropped vertically through a quench cabinet into which relatively cooler air, approximately 68° F. air, was evenly introduced. The fibers were attenuated and cooled in this controlled environment. Spin finish was applied to the filaments by a standard kiss roll located below the quench cabinet and the filaments wound onto a winder. It may be desirable to employ a post-spin draw operation to further reduce fiber diameter, particularly to achieve diameters of less than about 15 microns. Chopping the filaments into lengths suitable for web formation can also be done at this stage. It may be desirable to crimp the infrared opacified fibers especially if using high concentrations to form a web.

Incorporation of the two types of fibers into a web to achieve an intimate mixture of fibers can be conducted by any method known in the art. While opening/blending and carding are the presently preferred conventional techniques, other methods can be used, such as the blowing processes disclosed in U.S. Pat. Nos. 3,016,599 and 4,118,531.

SPECIFIC EMBODIMENTS

Example 1

The following method was used to prepare the infrared opacified fibers of the instant invention. Graphite powder, (Dixon 200-10, from Dixon Ticonderoga Company, N.J., U.S.A.) at a concentration of 8%, based on the total weight of the polymer and graphite, was dry blended with polypropylene resin (Exxon PD-3125, from Exxon Chemical Americas, Tex., U.S.A.). This mixture was fed into a twin-screw extruder which melted the polymer, and evenly distributed the graphite within the melted polymer and extruded the mixture, which was then cooled and chopped into pellets.

The resulting pellets were fed into an extruder, metered by a metering pump, and extruded through a horizontal spineret. The extruded filaments dropped vertically through a quench cabinet with approximately 68° F. air being evenly introduced. Spin finish was applied to the filaments by a standard kiss roll located below the quench cabinet and the filaments were wound onto a winder. This process produced fibers, with a mean diameter of approximately 11.7 microns, containing about 8% graphite.

Example 2

Webs were prepared comprising 100% polypropylene fibers of approximately the same diameter, with 8.4% graphite (Web X) and without graphite (Web Z). The fibers of Web X were prepared by the method set forth in Example 1, and they had a mean diameter of about 15.9 microns. The fibers of Web Z were obtained from Hercules Incorporated, Norcross, Ga., U.S.A., as Herculon ® Olefin Staple, and had a 15.4 micron calculated diameter based on the manufacturer's specification of about 1.5 denier per filament.

The thermal conductivity of Webs X and Z were measured using a Rapid k Tester apparatus according to ASTM C518 at 75° F. mean temperature. A summary of the measured values is in Table 1 below and these values are graphically depicted in FIG. 1, where the curves represent thermal conductivity as a function of loft.

TABLE I

Thermal Conductivity of a Web With Graphite vs. Without Graphite

| WEB | CONTENT | LOFT (L) ($ft^3$/lbs.) | THERMAL CONDUCTIVITY (k) (BTU-in/Hr.Sq.Ft.F.) |
|---|---|---|---|
| X | 100% PP with 8.4% graphite | 1.33 | 0.259 |
| | | 1.10 | 0.251 |
| | | 0.88 | 0.243 |
| | | 0.66 | 0.234 |
| Z | 100% PP without graphite | 1.82 | 0.354 |
| | | 1.52 | 0.326 |
| | | 1.20 | 0.298 |
| | | 0.91 | 0.271 |

PP = polypropylene

As can be seen from FIG. 1, the thermal conductivity of a web of 100% polypropylene fibers is substantially decreased by the addition of the infrared opacifying agent graphite to the polymer.

Example 3

Using the same infrared opacifed fiber forming process as in Example 1 and conventional textile web forming processes, Webs A, B, C, D and E were made, having the compositions described in Table II.

The thermal conductivities of all webs were measured using a Rapid k Tester apparatus according to ASTM C518 at 75° F. mean temperature. The measured thermal conductivity values are summarized in Table II below and graphically represented in FIG. 2, where thermal conductivity is plotted as a function of loft.

TABLE II

Thermal Conductivity of Webs of the Invention vs. Conventional Technology

| WEB | CONTENT | LOFT (L) ($ft^3$/lbs.) | THERMAL CONDUCTIVITY (k) (BTU-in/Hr Sq Ft F) |
|---|---|---|---|
| A | 20% PP with 8% graphite and 80% PET | 3.85 | 0.392 |
| | | 2.56 | 0.325 |
| | | 1.30 | 0.260 |
| B | 40% PP with 8% graphite and 60% PET | 2.94 | 0.325 |
| | | 1.96 | 0.283 |
| | | 0.98 | 0.243 |
| C | 60% PP with 8% graphite and 40% PET | 3.23 | 0.321 |
| | | 2.17 | 0.279 |
| | | 1.09 | 0.238 |
| D | 100% PET | 3.45 | 0.503 |
| | | 2.33 | 0.397 |
| | | 1.15 | 0.293 |
| E | 20% PP without graphite and 80% PET | 3.04 | 0.442 |
| | | 2.02 | 0.359 |
| | | 1.52 | 0.317 |

PP = polypropylene, 11.7 micron mean fiber diameter
PET = polyethylene terephthalate, 5.5 denier per filament DuPont Hollofil ® II As demonstrated in FIG. 2, none of the conventional materials (D and E), i.e., those not containing graphite, matched the thermal performance of the inventive webs (A, B and C) comprising an intimate mixture of bulking fibers and infrared opacified fibers containing the infrared opacifer, graphite.

It can also be seen that the thermal conductivity (k), at a loft (L), of an organic fibrous insulating blanket (A or B or C) comprised of an intimate mixture of a first set of bulking fibers and a second set of opacified fibers containing effective infrared absorbing amounts of an infrared absorbing additive is substantially less than $k_1$ and k is also substantially less than $k_2$, and $k_2$ is greater than $k_1$ wherein $k_1$ is the thermal conductivity at the same loft (L) of a blanket of said first set of bulking fibers and said second set of opacified fibers but with said second set of opacified fibers containing substantially none of said infrared absorbing additive and $k_2$ is the thermal conductivity at the same loft (L) of a blanket made solely of said bulking fibers.

At a loft of 2.0 cubic feet per pound (125 cc per gram), $k_2$ and $K_1$ are typically at least 5% greater than k.

Although the invention has been described in terms of specific embodiments of a manner in which the invention may be practiced, this is by way of illustration only and the invention is not necessarily limited thereto since alternative embodiments and operating techniques will become apparent to those skilled in the art. Accordingly, modifications are contemplated which can be made without departing from the spirit of the described invention.

What I claim is:

1. A thermally insulating fiber comprising a blend of polypropylene and from about 4% to about 8.5% graphite evenly distributed within the polypropylene, said fiber being capable of absorbing infrared radiation and having a diameter of less than about 20 microns, said graphite being present in an amount sufficient to provide a fiber which when formed to a thermal insulating web provides for a web having an improved insulating value compared to a web formed from said polypropylene fiber but without graphite therein.

2. The fiber of claim 1 wherein said graphite is present in an amount of from about 8.0% to about 8.5%.

3. The fiber of claim 1 wherein said fiber is one having a diameter of less than 15 microns.

4. The thermally insulating fiber of claim 1 wherein said graphite is present in an amount of from about 8.0% to about 8.5% and wherein said fiber is capable of being combined with a crimped polyethylene terephthalate bulking fiber to produce an insulating web having a thermal conductivity between about 0.22 to about 0.55 BTU-in/hour-ft sq.-°F.

* * * * *